United States Patent [19]

Catani et al.

[11] Patent Number: 4,596,102

[45] Date of Patent: Jun. 24, 1986

[54] ANCHOR FOR MASONRY VENEER

[75] Inventors: Mario J. Catani, Buffalo Grove, Ill.; Donald R. Graham, Oregon, Ohio

[73] Assignee: Dur-O-Wal, Inc., Northbrook, Ill.

[21] Appl. No.: 570,278

[22] Filed: Jan. 12, 1984

[51] Int. Cl.[4] ..... E04B 1/38

[52] U.S. Cl. ..... 52/508; 52/710; 52/713

[58] Field of Search ..... 52/378, 379, 393, 506, 52/698, 710, 713, 434; 411/368, 399, 387, 386, 401, 424, 426

[56] References Cited

U.S. PATENT DOCUMENTS

| | | | |
|---|---|---|---|
| 1,854,633 | 4/1932 | Stephens | 52/215 |
| 2,403,359 | 7/1946 | Gerhold | 411/387 |
| 2,853,870 | 9/1958 | Sinner et al. | 52/378 |
| 3,030,670 | 4/1962 | Bigelow | 52/378 X |
| 3,341,998 | 9/1967 | Lucas | 52/379 |
| 3,353,312 | 11/1967 | Storch | 52/508 X |
| 3,640,043 | 2/1972 | Querfeld et al. | 52/508 |
| 4,021,990 | 5/1977 | Schwalberg | 52/479 |
| 4,373,314 | 2/1983 | Allan | 52/379 X |

OTHER PUBLICATIONS

"Technical Notes on Brick Construction" (Jan./Feb., 1979 and Dec., 1980).

"Flexible Anchorage of Masonry Walls", R. E. Copeland.

"1983 Masonry Reinforcing Guide", AA Wire Products Co.

Heckmann Building Products, "Masonry Anchors & Ties".

Hohmann & Barnard, Inc., "Masonry Accessories".

Hohmann & Barnard, Inc., "Masonry Wall Reinforcing Anchors and Ties".

Dur-O-Wal, "Masonry Construction Anchors, Ties and Accessories" and price list.

New Product Information (Masonry Accessories).

Dur-O-Wal—"Unit Masonry Ties and Reinforcements".

Dur-O-Wal Catalog, "Jobber Price List" (Jul. 4, 1979).

Dur-O-Wal Catalog, "Unit Masonry Ties and Reinforcement".

Dur-O-Wal Catalog, "Masonry Construction Specialties and Accessories".

*Primary Examiner*—Carl D. Friedman

*Assistant Examiner*—Naoko N. Slack

*Attorney, Agent, or Firm*—Jenner & Block

[57] ABSTRACT

An anchor for tying between a sequentially layered veneer and a backup system. The anchor comprises a channel with a slotted web for accepting an anchoring means and apertured flanges pivotally receiving a formed wire tie. The anchor is adjustable translationally and pivotally as a unit. By locating the apertures in the flanges off center of the length of the elongate slot, pivoting of the channel 180° expands the vertical adjusting capability of the tie which is captured fixedly between successive layers.

4 Claims, 6 Drawing Figures

FIG. 1
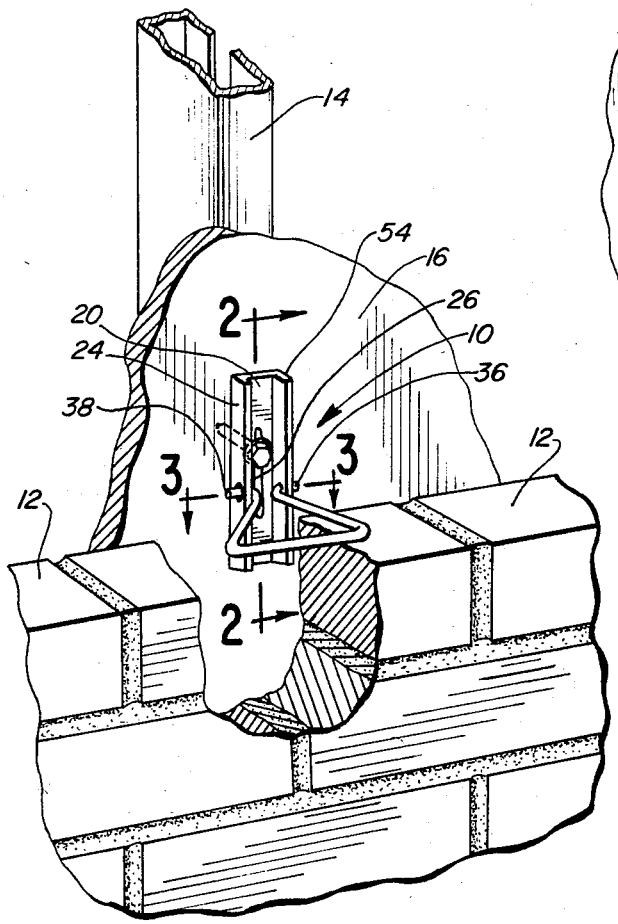
FIG. 2
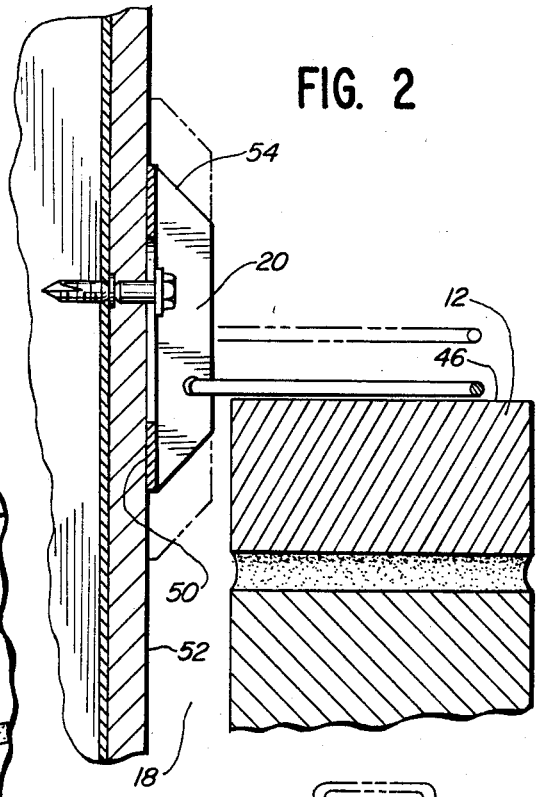
FIG. 4
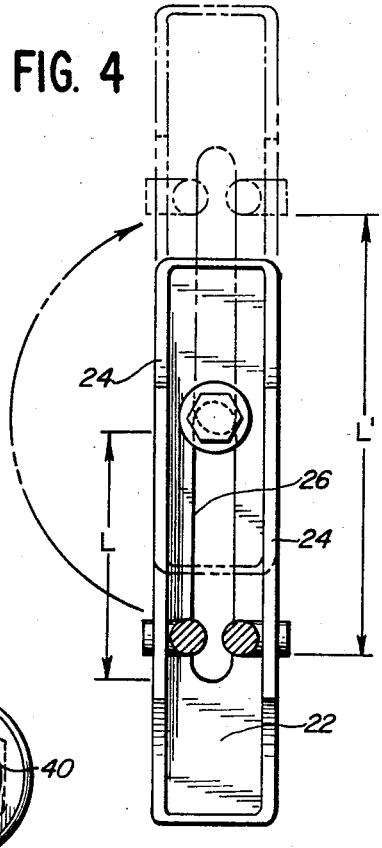
FIG. 3
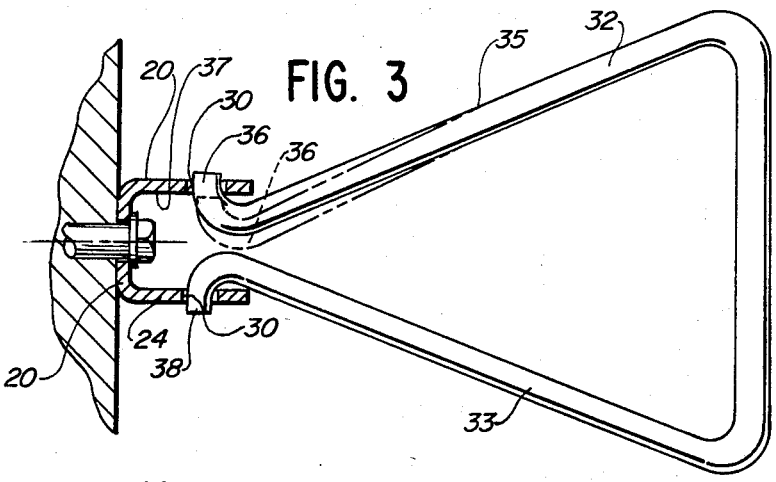
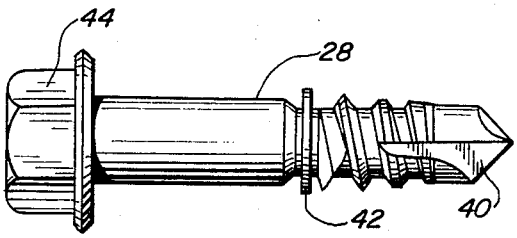
FIG. 5
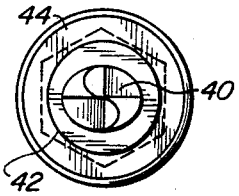
FIG. 6

ANCHOR FOR MASONRY VENEER

FIELD OF THE INVENTION

1. Background of the Invention

This invention relates to systems employing a sequentially layered masonry veneer and, more particularly, to an adjustable anchor for tying the veneer to a backup system.

2. Description of the Prior Art

An oft-used building system employs a weather-resisting facing isolated from and secured to a metal stud backup which carries a sheathing layer. The facing, or veneer, is generally sequentially layered brick and non-load bearing. The veneer is subject primarily to laterally imposed loads, which are borne cooperatively by both the veneer and backup system. Accordingly, provision must be made to securely tie the veneer and backup system and transmit forces therebetween.

One exemplary structure employs a flat plate with an integral bar defining an elongate slot between the bar and plate. Self-tapping screws are extended through the plate ends and rigidly anchor the plate to metal studs and in turn capture the sheathing layer in place. A tie ring, taking the shape of an incomplete triangle or rectangle with an interruption to admit the bar, slides vertically in the slot and is adjustable vertically to the height of a brick layer by the mason and is sandwiched by an overlying layer.

The above described anchor has several drawbacks. Anchoring of the plate requires the placement of two separate screws which must intersect the metal studs. Consequently, the plate must be maintained in a desired alignment as the tradesman inserts the screws in separate operations.

Further, given the compressible nature of the sheathing layer, which is normally drywall or the like, the plate may be anchored irregularly so that a force imparted by the tie ring as an incident of loading on the veneer will not be distributed perpendicular to or evenly over the sheathing area encountering the plate surface. Along the same line, when the tie ring is urged against the plate, the force is substantially concentrated, given the limited linear contact area between the plate and tie ring. As a result, the bearing force will not be evenly distributed over the plate area.

An additional drawback with the described plate is that the interruption in the tie ring is generally disposed at an end remote from the portion engaging the bar associated with the plate after assembly. As a result, to effect assembly, the tradesman must situate the tie ring so as to align the opening with the bar and then rotate the rod substantially 180° to misalign the opening and bar. This operation is time consuming and inconvenient.

Further, with the tie ring adjusted to meet the level of the masonry, the tie ring may be at one extremity or the other of the tie bar. The result again is that the tie ring bears unevenly on the plate.

Still further, a plate of substantial vertical dimension is required to permit the desired range of adjustment of the tie ring, given the stationary positioning of the plate. Manufacturing costs are elevated in proportion to the amount of material in the anchors.

The present invention is specifically directed to overcoming the above enumerated problems.

SUMMARY OF THE INVENTION

The present invention affords an anchor that can be simply fastened to the backup system, readily adjusted to meet the desired level of the masonry and which, regardless of the adjustment during assembly, effects facial engagement with the sheathing affording substantial distribution of force from the veneer over the backup system.

To accomplish this end, a channel is provided having a flat web with an elongate slot and integral spaced, flange portions extending transversely from the web. A separate tie is provided and preferably formed from a wire that is rigid but has some inherent flexibility. The wire is bent to form a loop to provide an expanded anchoring surface for positioning on the brick layer and defines oppositely outturned free ends which are received in apertures in the flanges so as to allow pivoting of the tie relative to the channel.

The anchor can be assembled with the tie in place or alternatively the tie can be fit with the mounted channel by compressing the free ends of the tie towards each other and locating them in their respective apertures. The channel itself is preferably attached by a single shoulder-type, self-tapping screw. The screw is extended through the elongate slot and sheathing and into the metal stud. A fixed shoulder abuts the stud upon a predetermined penetration to prevent further travel and accounts for consistent location of the screw. An enlarged head on the screw abuts the web about the slot in the channel to prohibit escape thereof. With the shoulder encountering the stud, the head is spaced from the web to permit pivoting thereof about the screw. Vertical adjustment is accomplished by shifting the entire anchor, including the channel, relative to the screw.

It is another object of the invention to minimize the amount of material required to manufacture the anchor without compromising its range of adjustment. To accomplish this end the apertures in the webs for receiving the tie ends are off center of the length of the slot and preferably adjacent an end thereof. By pivoting the channel 180° about the screw, the range of adjustment of the tie can be nearly doubled. The channel can be accordingly made a length approximately one half that of the prior art structure for the same anchor adjustment range.

With the described structure, a force on the tie as an incident of movement of the veneer causes the channel to facially engage the sheathing layer. The pressure applied by the tie through the flanges is transmitted evenly over the web regardless of the adjustments made.

BRIEF DESCRIPTION OF THE DRAWINGS

FIG. 1 is a perspective view of an anchor according to the present invention assembled between a sequentially layered veneer and backup system;

FIG. 2 is a sectional view of the anchor taken along line 2—2 of FIG. 1;

FIG. 3 is an enlarged sectional view of the anchor taken along line 3—3 of FIG. 1;

FIG. 4 an enlarged, fragmentary front view of the anchor of FIG. 1 illustrating its range of adjustment.

FIG. 5 is an enlarged, side elevational view of a shoulder-type screw used to fasten the anchor to a backup system; and FIG. 6 is an end view of the screw of FIG. 5.

DETAILED DESCRIPTION OF THE DRAWINGS

A preferred form of the anchor is depicted in FIGS. 1–3 generally at 10 for tying a sequentially layered brick veneer 12 with a backup metal stud 14. The stud is covered with a sheathing layer 16, with the veneer 12 isolated from the sheathing by an air space 18. It should be understood that while brick is used as an exemplary material to demonstrate the invention, that the anchor functions equally efficiently with any sequentially layered material.

The anchor 10 comprises a U-shaped channel 20 including a web 22 and integral, spaced flanges 24. The web has an elongate slot 26 to admit a shoulder-type fastening screw 28 for mounting the anchor. The channel flanges 24 have a pair of apertures 30 that are preferably circular and coaxial for pivotally accepting the wire tie 32 and offset to be adjacent an end of the slot 26 for reasons that will become apparent below. The wire from which the tie is formed is a sufficiently heavy gauge to rigidly transmit a force between the veneer and backup and defines an expanded anchoring body 33 in the shape of a triangle. The body is sandwiched between successive brick layers during construction of the veneer. The body has unconnected free ends 36, 38 which are bent to project oppositely away from each other in substantially a common line and are pivotally received in the apertures 30 in the flanges 24.

To assemble the tie 32 with the channel 20, the tie is turned so that one leg 38 can be extended into one of the apertures 30. The tie is then twisted so that the unseated end 36 is compressed by the inside wall 37 of the flange 24 until the end 36 overlaps end 38 as indicated in phantom in FIG. 3. At this point, the end 36 can be located in axial alignment with the aperture 30. The residual force in the deformed leg 35 of the tie urges the free end 36 through the aperture in the flange to a seated position.

It can be seen that as the free ends of the ties are compressed towards each other in a common plane that they will interfere to prevent escape of the ends 36, 38 from the apertures. This prevents inadvertent removal of the tie from the channel. To remove either of the legs, the legs must be situated in overlapping relationship as previously described for assembly.

It should be noted that the diameter of the aperture 30 is greater than the diameter of the tie wire to facilitate assembly, allow free swiveling of the tie relative to the channel and accommodate a modicum of relative shifting between the veneer and the backup metal studs 14.

Assembly of the anchors 10 can be done with the tie either in place or separated from the channel. In either event, the screw 28 is located to intersect the anticipated height of the layer to which the tie is to be secured. The screw 28 is extended through the slot, the sheathing and into the stud 14.

The screw 28, which is identified as a shoulder-type screw, has a self-tapping end 40 and an intermediate annular shoulder 42. As the screw is rotated, penetration continues until the shoulder 42 is flush with the stud after which further advancement is prohibited. The screws account for a consistent depth of penetration into the stud without monitoring the applied torque. The head 44 of the screw is enlarged and has a diameter greater than the width of the slot 26 to prevent passage through the slot. The spacing between the shoulder 42 and head 44 is chosen to be slightly in excess of the combined thickness of the sheathing and the web. This provides a small degree of play which allows the channel to translate and rotate relative to the screw.

The entire anchor, to include the channel and tie, are translated to situate the tie at the upper edge 46 of the layer at which the tie is to seat. The tie can be pivoted to rest the same flushly as indicated in FIG. 2. A two dimensional adjustment capability is thereby afforded. The next layer is completed in turn to rigidly capture the tie.

It is another aspect of the invention to locate the apertures adjacent an end of the slot and off center of the length of the channel flanges as previously described. With this arrangement, the channel can be pivoted about the screw 180° to the phantom position in FIG. 4 so that the vertical adjustment range of the vertical adjustment range of the tie is nearly double that permitted by translation only. For example, with the tie at the lower region of the slot in FIG. 4, the degree of vertical adjustment of the tie through translation is represented by the distance L. Upon pivoting the anchor, the adjustment distance increases to that represented by L'. The anchor functions comparably as one with a web and slot correspondingly greater in length without the need for the additional material required for the longer channel. The reduction in material and savings as a result thereof in terms of storage and handling, etc. are evident. At the same time, the offset positioning of the tie allows unobstructed access to the slot for insertion of the screw by the tradesman.

The dimension of the channel and slot should be chosen so that distance L' is at least the height of a brick layer to compensate for any error in location of the screw.

It can be seen that with the aforementioned structure, a force applied by the veneer toward the metal stud is transmitted through the flanges to flushly, facially engage the back surface 50 of the web with the exposed force 52 of the sheathing layer. Consequently, the pressure applied by the surface 50 is substantially uniform as the channel tends to assume a face-to-face engagement with the sheathing surface 52.

The channel and tie should be made from a corrosion-resistant material with the ties a minimum of 3/16" diameter wire to provide the required force transmitting capability and at the same time to allow sufficient flexibility to insert the tie into the channel according to the invention. The ends 54 of the flanges may be squared as in FIG. 1 or tapered as in FIGS. 2 and 4. Tapering further reduces the amount of material required, however does not compromise force transmitting ability.

It should be understood that the foregoing detailed description was made for purposes of identifying the structure and its utility, with no unnecessary limitations to be derived therefrom.

We claim:

1. An improved anchor for connecting a backup system with a veneer including layers sequentially built in a first direction comprising:

a channel comprising a web and integral spaced flanges transverse to the plane of the web, each flange including an aperture; the web defining an elongate slot for accepting an anchoring means for adjustably mounting the channel to the backup system, a deformable wire tie member having spaced apart oppositely projecting legs extending into the flange apertures for pivoting movement of the tie member relative to the channel and the spacing between the legs and flange being chosen so that the legs must be overlapped to admit the legs into the apertures and to assemble the tie member with the channel.

2. The improved anchor according to claim 1 wherein said apertures in the flanges are substantially coaxially aligned and are offset from the center of the length of the elongate slot.

3. An anchor for connecting a backup system with a sequentially layered veneer comprising:

a channel member having a web and a pair of integral, parallel, spaced flanges each including an aperture;

a tie member having a body and oppositely projecting ends extending into the spaced apertures for relative pivoting of the tie and flanges;

an elongate slot in the web for accepting an anchoring member for adjusting movement of the channel member and an anchoring member, the anchoring member comprising a screw having a self-tapping end for penetration of the backup system, an enlarged screw head having a diameter greater than the width of the slot to prevent passage of the head therethrough and an integral screw shoulder between the head and the self-tapping end for abutment with the backup system, the screw shoulder being spaced apart from the screw head by a distance to provide a predetermined penetration of the screw into the backup system and a free screw shank portion which does not penetrate the backup system and channel web but which is of sufficient axial length to loosely maintain the web channel between the screw head and the backup system so as to permit pivoting and limited translational adjustment of the channel over the backup system during anchor installation.

4. An improved anchor for connecting a backup system with a veneer having layers sequentially built in a first direction, each layer having a dimension L′ measured in the first direction, the anchor comprising:

a channel having a substantially flat web for facial abutment with a surface of the backup system, an elongate slot in the web having an effective length of substantially $\frac{1}{2}L'$, and a flange extending transversely to the plane of the web and defining a flange aperture proximate to a distal end of the elongate slot;

a tie member for anchoring between successive veneer layers and having a portion extending into the flange aperture for pivoting movement relative to the flange; and means extending through the slot for anchoring the channel adjustably relative to the backup system, whereby said tie can be adjusted in the first direction by translating the channel through a first range of positions relative to the anchoring means, and whereby said anchor can be pivoted about the anchoring means to extend the adjusting capability of the tie in the first direction through a second range of positions by reason of the aperture being located proximate to a distal end of the elongate slot.

* * * * *